US005952902A

United States Patent [19]

Kich et al.

[11] Patent Number: 5,952,902

[45] Date of Patent: Sep. 14, 1999

[54] COAXIAL "M" SWITCH

[76] Inventors: Rolf Kich, 1624 Harper Ave., Redondo Beach, Calif. 90278; Richard L. Bennett, 926 W. Javelin St., Torrance, Calif. 90502; David M. Kershner, 7008 W. 85th St., Los Angeles, Calif. 90045; James D. Thompson, 424 Marine Ave., #A, Manhattan Beach, Calif. 90266

[21] Appl. No.: 09/267,837

[22] Filed: Mar. 12, 1999

[51] Int. Cl.[6] ..... H01H 53/00; H01P 1/10

[52] U.S. Cl. ..... 335/4; 335/5; 333/105

[58] Field of Search ..... 335/4, 5; 333/103–108, 333/100, 101

[56] References Cited

U.S. PATENT DOCUMENTS

| | | | |
|---|---|---|---|
| 4,298,847 | 11/1981 | Hoffman | 333/105 |
| 4,697,056 | 9/1987 | Hoffman | 200/153 |
| 4,920,324 | 4/1990 | Whittaker et al. | 333/106 |
| 5,063,364 | 11/1991 | Tsoi | 333/107 |
| 5,065,125 | 11/1991 | Thomson et al. | 335/5 |
| 5,155,456 | 10/1992 | Ruff et al. | 333/106 |
| 5,281,936 | 1/1994 | Ciezarek | 335/4 |
| 5,451,918 | 9/1995 | Sun | 335/4 |

*Primary Examiner*—Lincoln Donovan
*Assistant Examiner*—Tuyen Nguyen
*Attorney, Agent, or Firm*—Terje Gudmestad; Georgann Grunebach; Michael W. Sales

[57] ABSTRACT

A coaxial "M" switch having three coaxial input connectors (A, B, C) spaced evenly from each other, and three coaxial output connectors (1, 2, 3) identically arranged. In a cylindrical barrel embodiment (10) the input and output connectors are located at opposite ends of a cylindrical configuration. In one planar embodiment (30), the input and output connectors alternate with each other and define a hexagonal configuration (40). In another planar embodiment, the input connectors (A, B, C) define an inner triangular configuration (70) that is surrounded by the output connectors (1, 2, 3) defining an outer triangular configuration. In each embodiment, reeds are actuated in predetermined configurations to define three switch positions.

13 Claims, 4 Drawing Sheets

COAXIAL "M" SWITCH

TECHNICAL FIELD

The present invention relates to an "M" switch and more particularly, the present invention relates to a coaxial "M" switch.

BACKGROUND ART

In certain applications relating to the use of switches it becomes necessary to use specific switch configurations for specific redundancy sequences. An output redundancy ring provides for backup capabilities such as providing a plurality of amplifiers that can be switched in as a replacement for a failed amplifier. A typical configuration is known as an "M" configuration.

An "M" switch configuration table is shown in FIG. 1. An "M" switch 100 has three inputs and three outputs and the switch 100 is shown in each of its three possible positions. The inputs are labeled A, B, and C. The outputs are labeled 1, 2, and 3. A particular input port can be switched to any of the three outputs while the other two inputs are then each connected to one of the other two outputs.

In position one, input A is connected to output 1, input B is connected to output 2, and input C is connected to output 3. In position two, input A is connected to output 2, input B is connected to output 3, and input C is connected to output 1. In position three, input A is connected to output 3, input B is connected to output 1, and input C is connected to output 2.

One method of providing a particular redundancy ring involves using a waveguide "M" switch, which is the only type of "M" switch available. However, the input side of an amplifier is not compatible with waveguide switches and requires the use of waveguide switches along with coaxial adapters in order to be compatible with the waveguide "M" switch. The adapters add unwanted size, weight and cost to a particular switch application. This is highly desirable in space operations or any other application having very strict weight and size restrictions.

An alternative to a waveguide "M" switch with coaxial adapters is to group two "T" switches together forming an "M" configuration. However, two switches are twice as heavy, twice as bulky, and twice as lossy as an individual switch.

SUMMARY OF THE INVENTION

The present invention is a coaxial "M" switch that eliminates the need to use a waveguide "M" switch in conjunction with coaxial adapters and avoids using two "T" switches grouped to form an "M" configuration.

One embodiment of the present invention is a cylindrical shaped "M" switch configuration having the three inputs arranged 120° from each other at one end of the cylindrical form. The outputs are identically arranged 120° from each other at the other end of the cylindrical form. A lengthwise reed connects the input A and output 1 in the first switch position. A first diagonal reed connects the input A to the output 2 in the second position and a second diagonal reed connects the input A to the output 3 in the third position. Similar configurations exist for the remaining inputs and outputs all three positions. Magnets are used to actuate the reeds. A magnetic head located in the center of the "M" switch has three small bar magnets spaced every 60°. As the head rotates, it attracts one diagonal pair of reeds and one single reed, and repels the rest.

In another embodiment of the present invention, the "M" switch has a planar hexagonal configuration that has three reeds on a shaft that is perpendicular to the reeds. Three layers are used to build the "M" switch configuration.

Yet another embodiment of the present invention has a planar configuration with reeds surrounding a center pin. A combination of magnetic attractions and repulsions provides the "M" switch configuration.

It is an object of the present invention to provide an "M" switch configuration using a single switch and without the need for coaxial adapters. It is another object of the present invention to provide a coaxial "M" switch.

Other objects and features of the present invention will become apparent when viewed in light of the detailed description of the preferred embodiment when taken in conjunction with the attached drawings and appended claims.

BEST MODE(S) FOR CARRYING OUT THE INVENTION

Figure 2:
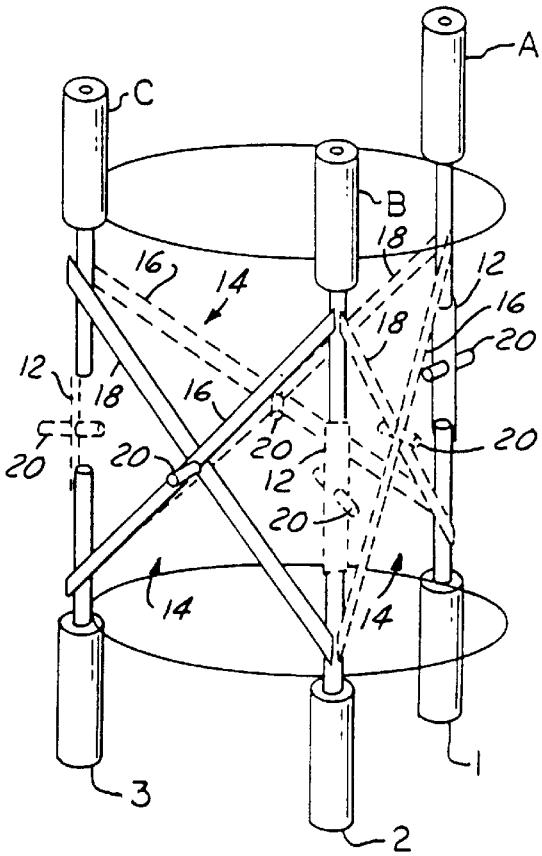
FIG. 2 is a perspective view of a cylindrical embodiment of an "M" switch of the present invention.

A first embodiment of a coaxial "M" switch of the present invention is shown in FIG. 2. The "M" switch 10 is best described as having a cylindrical barrel shape. Three input connectors, A, B, and C are coaxial connectors and are located at one end of the switch 10. The input connectors A, B, and C are evenly spaced 120° from each other. The output connectors, also coaxial connectors, 1, 2, and 3 are evenly spaced 120° from each other at the opposite end of the "M" switch 10.

A set of three single reeds 12 are located lengthwise between the inputs A, B, and C and the outputs 1, 2, and 3 for connecting each input to an output. Three sets of crossed pairs of reeds 14 connect an input to an output positioned 120° from the inline path. One reed 16 of the pair 14 makes a clockwise connection, the other reed 18 of the pair makes a counterclockwise connection. The pair 14 of reeds is mechanically connected. However, the reeds are RF isolated from one another.

Typically, each reed is located in a cavity in the switch housing. (The cavity and the switch housing are not shown on the Figures for clarity purposes since the present invention is related to the inner workings of the switch). The cavity forms the outer conductor of a coax line. Each coax line has its own cavity. The connection between reeds would typically penetrate a wall that separates two cavities. A dielectric material is used to support the shared wall which provides the electrical insulation necessary yet still provides the mechanical motion required to simultaneously move the reeds. This description is provided for example purposes only. There are other variations that are more complex and one skilled in the art is capable of understanding the RF isolation of the reeds.

A magnet 20 is attached to each of the single reeds 12 and at the point of intersection of the crossed pairs 14. The magnet's 12 polarities are set such that the magnets 20 on the single reeds 12 have and opposite polarity from the magnets 20 on the crossed pairs 14. For example, all of the single reeds 12 have magnets 20 having the north pole facing inward and the crossed reed pairs 14 have magnets 20 having the south pole facing inward. An example arrangement for the magnets and their polarities is shown in the FIGS. 3A, 3B and 3C as "N" for north and "S" for south.

Figure 3A:
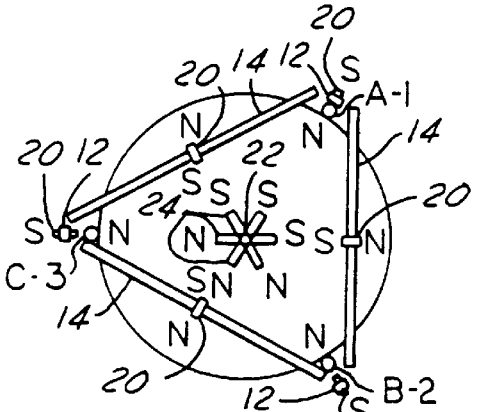
FIG. 3A is a sectional view of the cylindrical shaped coaxial "M" switch in position 1.
Figure 3B:
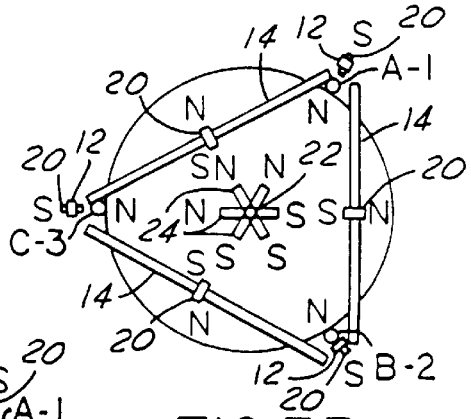
FIG. 3B is a sectional view of the cylindrical shaped coaxial "M" switch in position 2.

Referring now to FIGS. 3A through 3B, a central shaft 22 has three bar magnets 24 set at 120° intervals to each other so that each end of each magnet 24 is 60° from the end of an adjacent magnet 24 creating a rotor 26. The polarities of the rotor magnets 24 are arranged as N, N, N, and S, S, S.

Figure 3C:
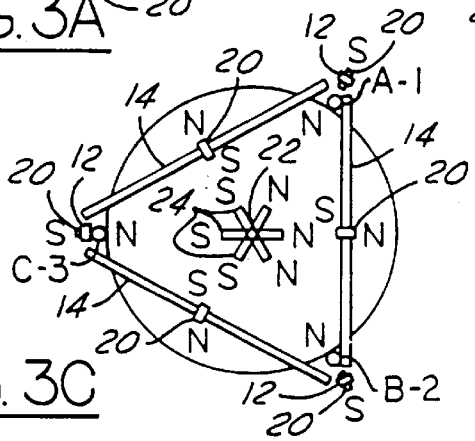
FIG. 3C is a sectional view of the cylindrical shaped coaxial "M" switch in position 3.

The operation of the "M" switch is best described with reference to FIGS. 3A, 3B, and 3C. In position 1, shown in FIG. 3A, the rotor's south pole attracts the reed 12 between input A and output 1 because the north pole of the magnet 20 on the reed 12 is facing inward. The crossed reed pairs 14 between input B and output 3 and input C and output 2 are also attracted since the rotor magnets' 24 north pole faces the south pole of the magnets 20 on the crossed pairs 14. In this position, input B and output 2 and input C and output 3 are repelled since the magnets 20 are set with the north pole inward facing the north pole on the magnets 24 of the rotor 26. Likewise the remaining crossed pairs, i.e. the reeds located between input C and output 3, input A and output 3, input B and output 1, input A and output 2, are also repelled, since the inward facing polarities of the magnets 20 on the reed pairs 14, have the same polarity as the magnets 24 on the rotor 26, south-south in the present example.

To move the switch into position 2, the rotor 26 is rotated 120° clockwise. In this position, the single reed 12 between input B is attracted to output 2 and the crossed reed pair 14 between input C and output 1 and input A and output 3 is also attracted. The remaining pairs 14 and single reeds 12 are repelled.

To reach position 3, the rotor is rotated clockwise an additional 120°. The single reed 12 between input C and output 3 is attracted. The pair of crossed reeds 14 connecting input A to output 2 and input B to output 1 is also attracted. All other single reeds 12 and crossed reed pairs 14 are repelled.

In the present example, the magnets 20 and 24 provide attracting and repelling forces. However, it is possible to use other mechanisms, such as cams (not shown), to move the reeds.

Figure 4:
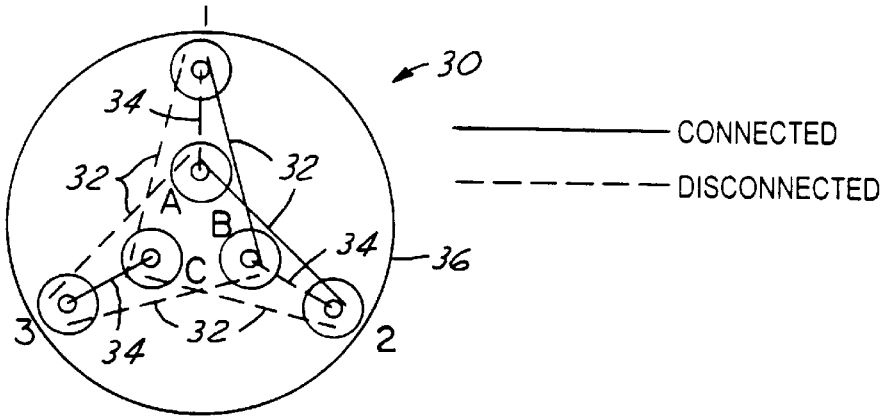
FIG. 4 is a planar view of a planar triangular embodiment of the coaxial "M" switch.

In another embodiment, the switch 30 has a planar triangular configuration as shown in FIG. 4. The three input connectors A, B, and C are positioned such that they form an inner triangle. The three output connectors 1, 2, and 3 are positioned such that they form an outer triangle around the inner triangle of input connectors A, B, and C.

Figure 1:
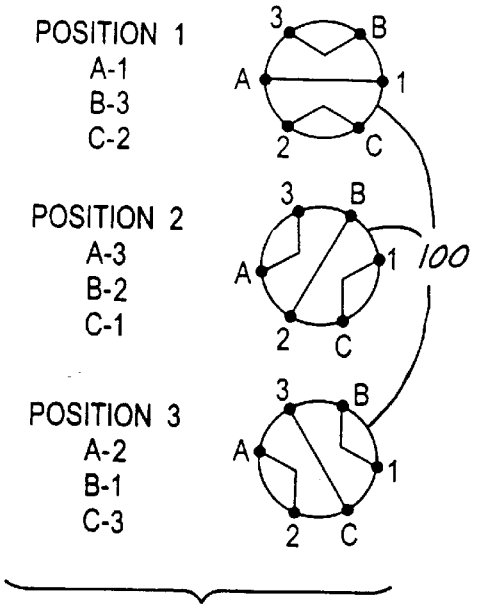
FIG. 1 is a table of the three positions for an "M" switch configuration.

A pair of crossed reeds 32 connects the inner ports to the adjacent outer ports, i.e., the input A to outputs 2 and 3, input B to outputs 1 and 3, and input C to outputs 1 and 2. Single reeds 34 connect the inner ports at the corners of the inner triangle to the outer ports at the corners of the outer triangle, i.e., input A to output 1, input B to output 2 and input C to output 3. Magnets (not specifically shown) are located on the reeds 32 and 34 and on a disk 36 underneath the reeds 32 and 34. As the disk rotates, the connection sequence outlined in FIG. 1 is achieved.

Figure 5:
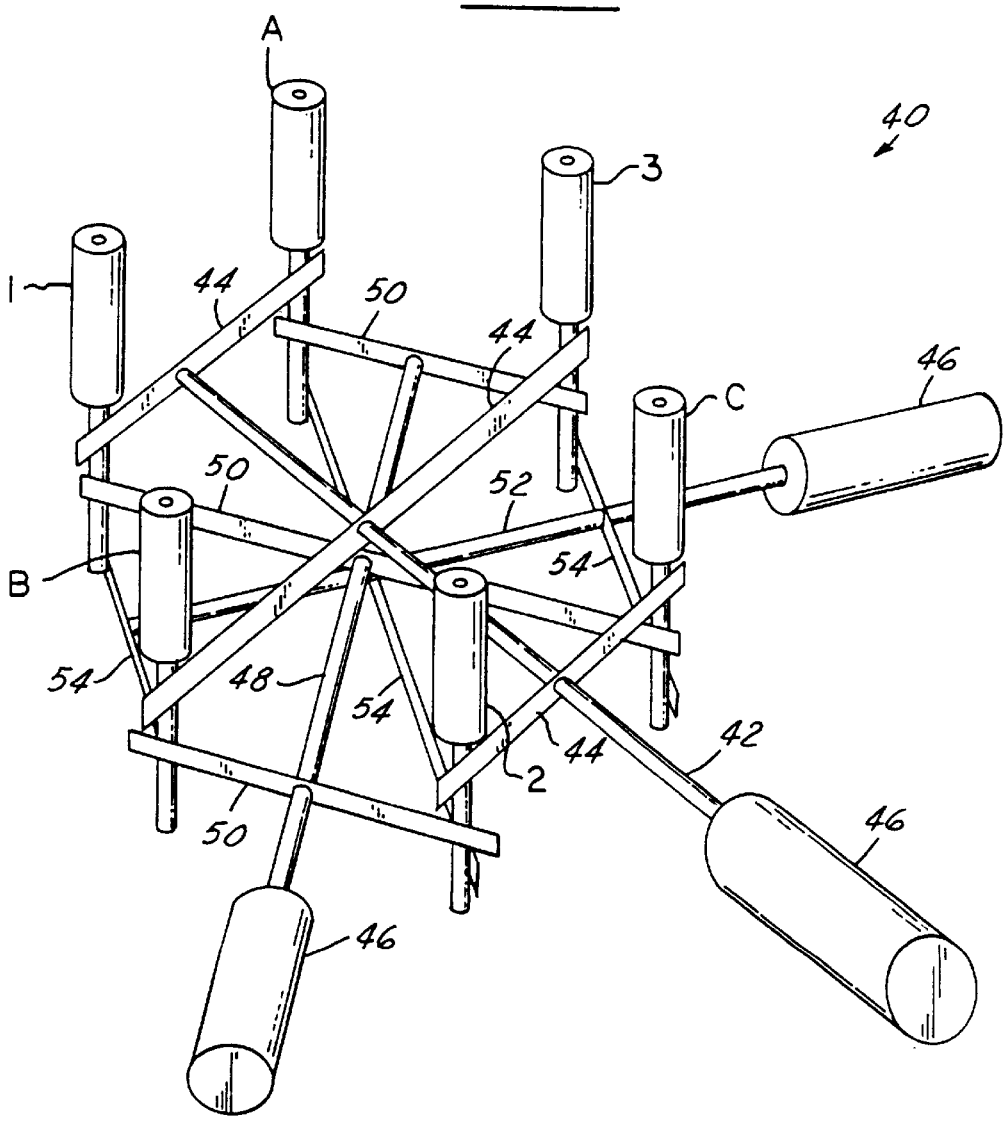
FIG. 5 is a perspective view of another embodiment of the coaxial "M" switch having a planar hexagonal configuration and solenoid acutators.

Another planar embodiment of the switch of the present invention takes the shape of a hexagon 40 and is shown in FIG. 5. The input connectors A, B, and C and the output connectors 1, 2, and 3 are spaced apart defining the points of a hexagon. A dielectric shaft 42 has a set of three reeds 44 attached to and perpendicular with the shaft 42 for connecting input ports A, B, and C to output ports 1, 2, and 3 respectively. A solenoid 46 is attached to one end of the dielectric shaft 42 for moving the reeds 44 back and forth. This completes a first layer of the hexagonal switch 40. A second layer has a dielectric shaft 48 and a set of three reeds 50 connecting input A to output 3, input B to output 1 and input C to output 2. Finally, a third layer has a dielectric shaft 52 with a set of three reeds 54 connecting input A to output 2, input B to output 1 and input C to output 3. The dielectric shafts 48 and 52 each have a solenoid 46 for actuating the reeds 50 and 54. As a solenoid 46 is actuated, its respective reeds 44, 50 or 54 make the connection between the input and output connectors.

Figure 6:
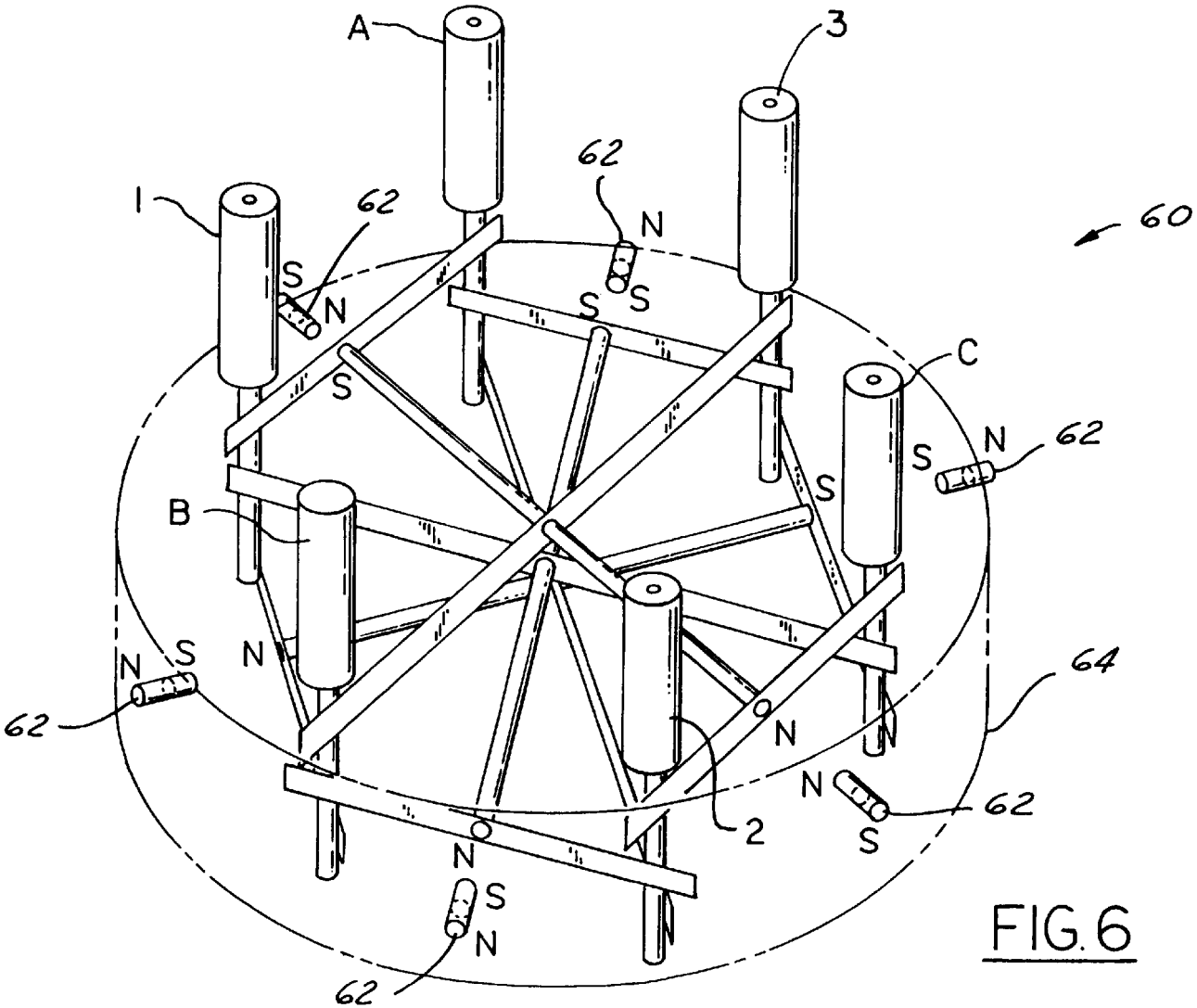
FIG. 6 is a perspective view of yet another embodiment of the coaxial "M" switch having a planar hexagonal configuration and magnetic actuators.
Figure 7:
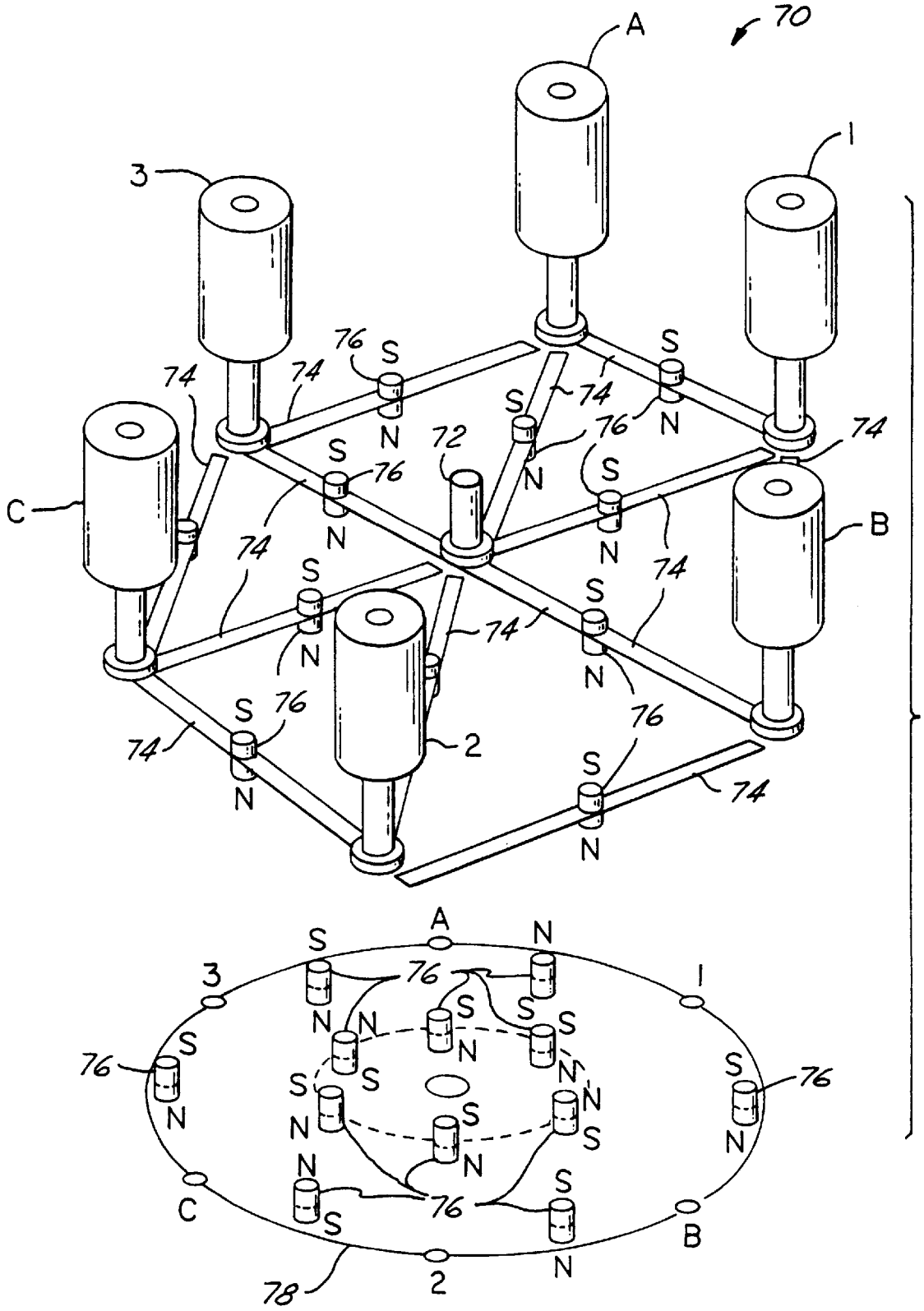
FIG. 7 is an exploded perspective view of still another embodiment of the planar coaxial "M" switch of the present invention.

As an alternative to the solenoids 46 shown in FIG. 5, it is possible to configure the hexagonal switch with magnets. The magnetic hexagonal switch 60 is shown in FIG. 6. Magnets 62 are located on all of the sets of reeds 44, 50 and 54 and on an outer rotor housing 64. As the rotor moves, the magnets 62 either repel or attract the reeds. One set of reeds will be connected to the connector ports A, B, C, 1, 2, and 3 while the other two sets of reeds are repelled as outlined in FIG. 1. This is repeated for each position of the switch 30.

Yet another embodiment of the present invention is a planar hexagonal switch 70 having only one layer as opposed to three layers. Single reeds 74 interconnect the input and output connectors to each other as well as interconnect the input and output connectors to a pin 72 centrally located in the center of the switch 70. Magnets 76 are located on each reed 74. A rotor plate 78 is located underneath the connectors A, B, C, 1, 2, and 3, and reeds 74. Magnets 76 are also located on the rotor plate 78 in a configuration that matches the configuration of the magnets above the plate 78. The magnets 76 on the hexagonal switch 70 have consistent polarizations. The magnets 76 on the rotor plate 78 have a polarity pattern that sequences the "M" switch 70 through the positions outlined in FIG. 1. For example, the polarities of the magnets 76 on the rotor plate 78 are N, S, S, N, S, S.

As the plate 78 is rotated, the reeds 74 are either attracted or repelled by the magnets 76, making the connections between the connectors. Mechanical cams or pins (not shown) can be used in place of the magnets in order to actuate the reeds.

While particular embodiments of the invention have been shown and described, numerous variations and alternate embodiments will occur to those skilled in the art. Accordingly, it is intended that the invention be limited only in terms of the appended claims.

What is claimed is:

1. A coaxial "M" switch comprising:

first, second and third coaxial input connecters spaced 120° from each other;

first, second and third coaxial output connectors spaced 120° from each other;

a first singular reed located between said first input connector and said first output connector;

a second singular reed located between said second input connector and said second output connector;

a third singular reed located between said third input connector and said third output connector;

a first pair of crossed reeds having one reed of said first pair located between said first input connector and said second output connector, another reed of said first pair located between said second input connector and said first output connector;

a second pair of crossed reeds having one reed of said second pair located between said first input connector and said third output connector, another reed of said second pair located between said third input connector and said first output connector;

a third pair of crossed reeds having one reed of said third pair located between said third input connector and said second output connector, another reed of said third pair located between said second input connector and said third output connector;

means for actuating said reeds to make a connection between predetermined input connectors and predetermined output connectors defining first, second and third switch positions;

means for altering said means for actuating to achieve one of said three switch positions;

whereby said first switch position is defined by a connection of said first singular reed between said first input connector and said first output connector, and a connection of said third pair of crossed reeds between said second input connector and said third output connector and said third input connector and said second output connector, said second switch position is defined by a connection of said second singular reed between said second input connector and said second output connector, and a connection of said second pair of crossed reeds between said first input connector and said third output connector and a connection between said third input connector and said first output connector, and said third switch position being defined by a connection of said third singular reed between said third input connector and said third output connector, and a connection of said first pair of crossed reeds between said first input connector and said second output connector and a connection between said third input connector and said first output connector.

2. The coaxial "M" switch as claimed in claim 1 wherein said first, second and third coaxial input connectors define a circular pattern in a first plane and said first second and third coaxial output connectors define a circular pattern in a second plane spaced a distance from said first plane thereby defining a cylindrical barrel shape.

3. The switch as claimed in claim 2 wherein said means for making a connection further comprises:

a magnet located on each of said first, second and third singular reeds, said magnets having similar poles facing inward;

a magnet located at said point of intersection of each of said first, second and third pairs of crossed reeds, said magnets having similar poles facing inward, said inwardly facing poles of said magnets on said first, second and third crossed pairs being opposite in polarity from said inwardly facing poles of said magnets on said first, second and third singular reeds; and said means for altering said means for making a connection further comprises a rotor having three bar magnets arranged such that their south poles are adjacent one another and their north poles are adjacent one another for altering said connections to one of said three positions.

4. The switch as claimed in claim 1 wherein said means for making a connection further comprises mechanical cams.

5. The coaxial "M" switch as claimed in claim 1 wherein said first, second and third coaxial input connectors are in one plane and define an inner triangular configuration, said first, second and third coaxial output connectors are in the same plane as said first, second and third coaxial input connectors, said first, second and third coaxial output connectors define an outer triangular configuration surrounding said inner triangular configuration.

6. The switch as claimed in claim 5 wherein said means for making a connection further comprises magnetic actuation of said reeds.

7. The switch as claimed in claim 5 wherein said means for making a connection further comprises cam mechanisms.

8. A coaxial "M" switch comprising:

first, second and third coaxial input connectors spaced evenly from each other;

first, second and third coaxial output connectors spaced evenly from each other and located between said first second and third input connectors respectively whereby said input and output connectors define corners of a hexagonal configuration;

a first dielectric shaft positioned through the center of said hexagonal configuration;

a first set of three reeds located on said first dielectric shaft and positioned perpendicular to said first dielectric shaft, one of said reeds of said first set being located between said first input connector and said first output connector, a second of said reeds of said first set being located between said second input connector and said third output connector, and a third reed of said first set being located between said third input connector and said second output connector;

a second dielectric shaft positioned through the center of said hexagonal configuration;

a second set of three reeds located on said second dielectric shaft and positioned perpendicular to said second dielectric shaft, one of said reeds of said second set being located between said second input connector and said second output connector, a second of said reeds of said second set being located between said third input connector and said first output connector, and a third reed of said second set being located between said first input connector and said third output connector;

a third dielectric shaft positioned through the center of said hexagonal configuration;

a third set of three reeds located on said third dielectric shaft and positioned perpendicular to said third dielectric shaft, one of said reeds of said third set being located between said third input connector and said third output connector, a second of said reeds of said third set being located between said first input connector and said second output connector, and a third reed of said third set being located between said second input connector and said first output connector; and means for actuating one of said first, second and third sets of reeds to make a connection between said reeds and said input and output connectors to define first, second and third switch positions respectively.

9. The switch as claimed in claim 8 wherein said means for actuating said first, second and third sets of reeds further comprises first, second and third solenoids attached to said first, second and third dielectric shafts respectively.

10. The switch as claimed in claim 8 wherein said means for actuating said first, second and third sets of reeds further comprises:

a magnet on each of said first, second and third dielectric shafts;

a rotor surrounding said hexagonal configuration;

a plurality of magnets located on said rotor, said plurality of magnets having alternating polarities such that as said plurality of magnets on said rotor are aligned with said dielectric shaft magnets, said plurality of magnets are attracted to a respective magnet on said first, second and third dielectric shafts having a polarity opposite the polarity of the corresponding magnet of said plurality of magnets, and said plurality of magnets are repelled by a respective magnet on said first second and third dielectric shafts having the same polarity as the plurality of magnets thereby making a connection between said reeds and connectors for one of said three switch positions.

11. A coaxial "M" switch comprising:

first, second and third coaxial input connectors spaced evenly from each other;

first, second and third coaxial output connectors spaced evenly from each other and located between said first second and third input connectors respectively whereby said input and output connectors define corners of a hexagonal configuration;

a pin centrally located at a hub of said hexagonal configuration;

a plurality of singular reeds located between adjacent input and output connectors and between said input and output connectors and said pin; and means for actuating said plurality of reeds such that a first switch position is defined by the connection between said first input connector and said first output connect, said second input connector and said third output connector and said third input connector and said second output connector, a second switch position is defined by the connection between said second input connector and said second output connector, said first input connector and said third output connector, and said third input connector and said first output connector and a third switch position is defined by a connection between said third input connector and said third output connector, said first input connector and said second output connector and said second input connector and said first output connector.

12. The switch as claimed in claim 11 wherein said means for actuating said plurality of reeds further comprises:

a magnet located on each of said plurality of singular reeds defining a pattern of magnets, each magnet having the same polarity;

a rotor spaced a distance from and located below said plurality of singular reeds;

a plurality of magnets having a pattern matching the pattern of magnets for said plurality of reeds, two adjacent magnets of said plurality of magnets having matching polarity, a third magnet of said plurality of magnets having a polarity different from said polarity of said two adjacent magnets;

whereby said rotor is positioned such that each magnet of said plurality of magnets is aligned with a magnet on said plurality of reeds, magnets having opposite polarities will attract respective reeds making a connection and magnets having similar polarities will repel respective reeds.

13. The switch as claimed in claim 11 wherein said means for actuating said plurality of reeds further comprises mechanical cams.

* * * * *